US009419395B1

(12) United States Patent
Morvillo

(10) Patent No.: US 9,419,395 B1
(45) Date of Patent: Aug. 16, 2016

(54) SWIVEL JOINT CHARGING CONNECTOR

(71) Applicant: Stephen Morvillo, Ridge, NY (US)

(72) Inventor: Stephen Morvillo, Ridge, NY (US)

( * ) Notice: Subject to any disclaimer, the term of this patent is extended or adjusted under 35 U.S.C. 154(b) by 0 days.

(21) Appl. No.: 14/802,777

(22) Filed: Jul. 17, 2015

(51) Int. Cl.
*H01R 25/00* (2006.01)
*H01R 27/02* (2006.01)
*H01R 107/00* (2006.01)

(52) U.S. Cl.
CPC ..... *H01R 27/02* (2013.01); *H01R 2107/00* (2013.01)

(58) Field of Classification Search
CPC ..... H01R 35/04; H01R 27/02
USPC ..... 439/8, 31
See application file for complete search history.

(56) References Cited

U.S. PATENT DOCUMENTS 6,695,620 B1 * 2/2004 Huang ..... H01R 13/562 439/11
6,893,267 B1 * 5/2005 Yueh ..... H01R 35/04 439/8
6,991,467 B1 * 1/2006 Cheng ..... H01R 35/04 439/10
7,025,595 B1 * 4/2006 Chan ..... H01R 35/04 439/6
7,066,753 B1 * 6/2006 Tseng ..... H01R 35/02 439/259
7,172,428 B2 * 2/2007 Huang ..... H01R 35/00 439/11
7,614,903 B1 * 11/2009 Huang ..... H01R 13/5841 439/362
7,658,557 B2 * 2/2010 Lu ..... G03B 19/00 348/207.1
7,811,136 B1 10/2010 Hsieh et al.
8,000,090 B2 * 8/2011 Moscovitch ..... F16M 11/10 361/679.04
8,157,569 B1 * 4/2012 Liu ..... H01R 35/04 439/11
8,226,419 B2 * 7/2012 Fonzo ..... H01R 35/02 439/11
8,517,743 B2 * 8/2013 Robb ..... G02B 6/0096 439/8
8,672,693 B2 * 3/2014 Liu ..... H01R 13/44 439/131
8,777,671 B2 * 7/2014 Huang ..... H01R 35/04 439/11
2004/0105329 A1 * 6/2004 Lin ..... H05K 5/0278 365/202
2007/0126290 A1 * 6/2007 Jaynes ..... H02J 7/0044 307/150
2011/0237099 A1 * 9/2011 Ni ..... G06K 19/07732 439/142
2015/0222048 A1 * 8/2015 Goulbourne ..... H01R 13/5841 439/456

* cited by examiner

*Primary Examiner* — Tulsidas C Patel
*Assistant Examiner* — Peter G Leigh
(74) *Attorney, Agent, or Firm* — Crossley and Stevenson Intellectual Property Law

(57) ABSTRACT

A swivel joint charging connector including a swivel ball joint having an exterior shell disposed around a rotatable ball and a pair of apertures disposed on the exterior shell of the swivel ball joint. A USB connector has a body portion attached to the exterior shell of the swivel ball joint. A wire cover is disposed through one of the pair of apertures and attached to the ball. The wire cover is continuously disposed around a wire. The wire is continuously disposed through the ball and each of the pair of apertures. The right end of the wire is attached to the USB connector and the left end of the wire is attached to a power connector.

3 Claims, 3 Drawing Sheets

SWIVEL JOINT CHARGING CONNECTOR

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of charging connectors are known in the prior art. However, what has been needed is a swivel joint charging connector including a swivel ball joint, a pair of apertures disposed through an exterior shell of the swivel ball joint, a Universal Serial Bus (hereinafter "USB") connector attached to the exterior shell of the swivel ball joint at a first aperture of the pair of apertures, and a wire cover disposed through a second aperture of the pair of apertures. What has been further needed is for the wire cover to be disposed around a wire, with the wire continuously disposed through the swivel ball joint. A right end of the wire is attached to the USB connector and a left end of the wire is attached to a power connector. Lastly, what has been needed is for a ball of the swivel ball joint to be configured to have 360 degrees of pivotable rotation in order to provide simultaneous rotation to the wire. The swivel joint charging connector thus prevents a wire of a phone charger from becoming tangled and eventually breaking as a result of its stationary position within the components of the phone charger.

FIELD OF THE INVENTION

The present invention relates to charging connectors, and more particularly, to a swivel joint charging connector.

SUMMARY OF THE INVENTION

The general purpose of the present swivel joint charging connector, described subsequently in greater detail, is to provide a charging connector which has many novel features that result in a swivel joint charging connector which is not anticipated, rendered obvious, suggested, or even implied by prior art, either alone or in combination thereof.

To accomplish this, the present swivel joint charging connector includes a swivel ball joint having an exterior shell disposed around a rotatable ball. A pair of apertures is disposed on the exterior shell of the swivel ball joint. The pair of apertures includes a first aperture and a second aperture. Each of the first aperture and the second aperture has an upper edge and a lower edge. The first aperture is collinearly disposed with the second aperture. A USB connector has a male plug and a body portion. The body portion has a front end attached to the male plug and a curved back end continuously attached to the exterior shell of the swivel ball joint at each of the upper edge and the lower edge of the first aperture. A wire cover is disposed through the second aperture and attached to the ball. A diameter of the wire cover substantially conforms to a diameter of the second aperture. The wire cover is continuously disposed around a wire having a right end and a left end. The wire is continuously disposed through the ball and each of the first aperture and the second aperture. The right end of the wire is attached to the USB connector, and the left end of the wire is attached to a power connector. The power connector is optionally an outlet power plug and, alternately, a cigarette lighter plug. The ball is configured to have 360 degrees of pivotable rotation in order to provide simultaneous rotation to the wire.

Thus has been broadly outlined the more important features of the present swivel joint charging connector so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
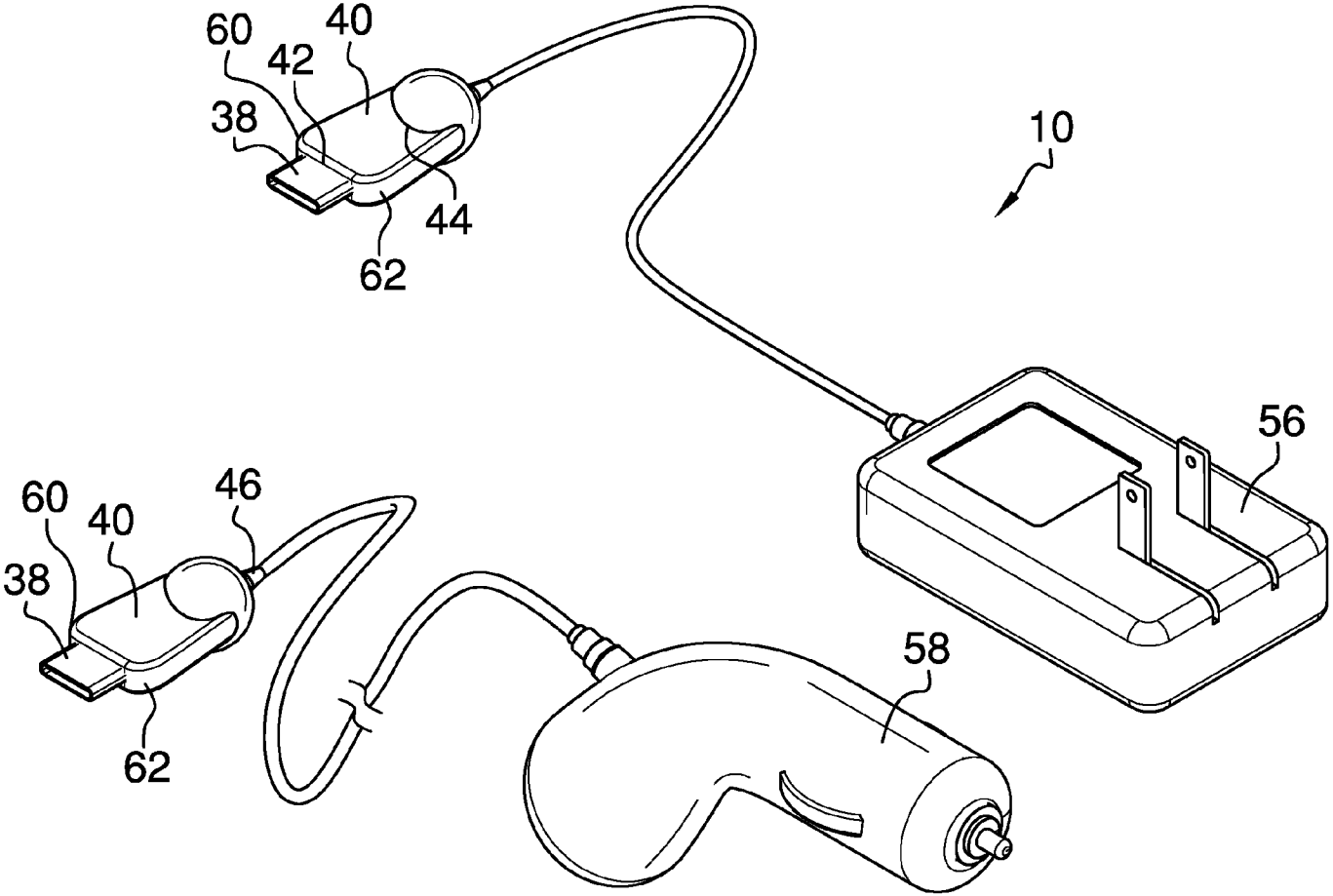
FIG. 1 is a front isometric view.
Figure 2:
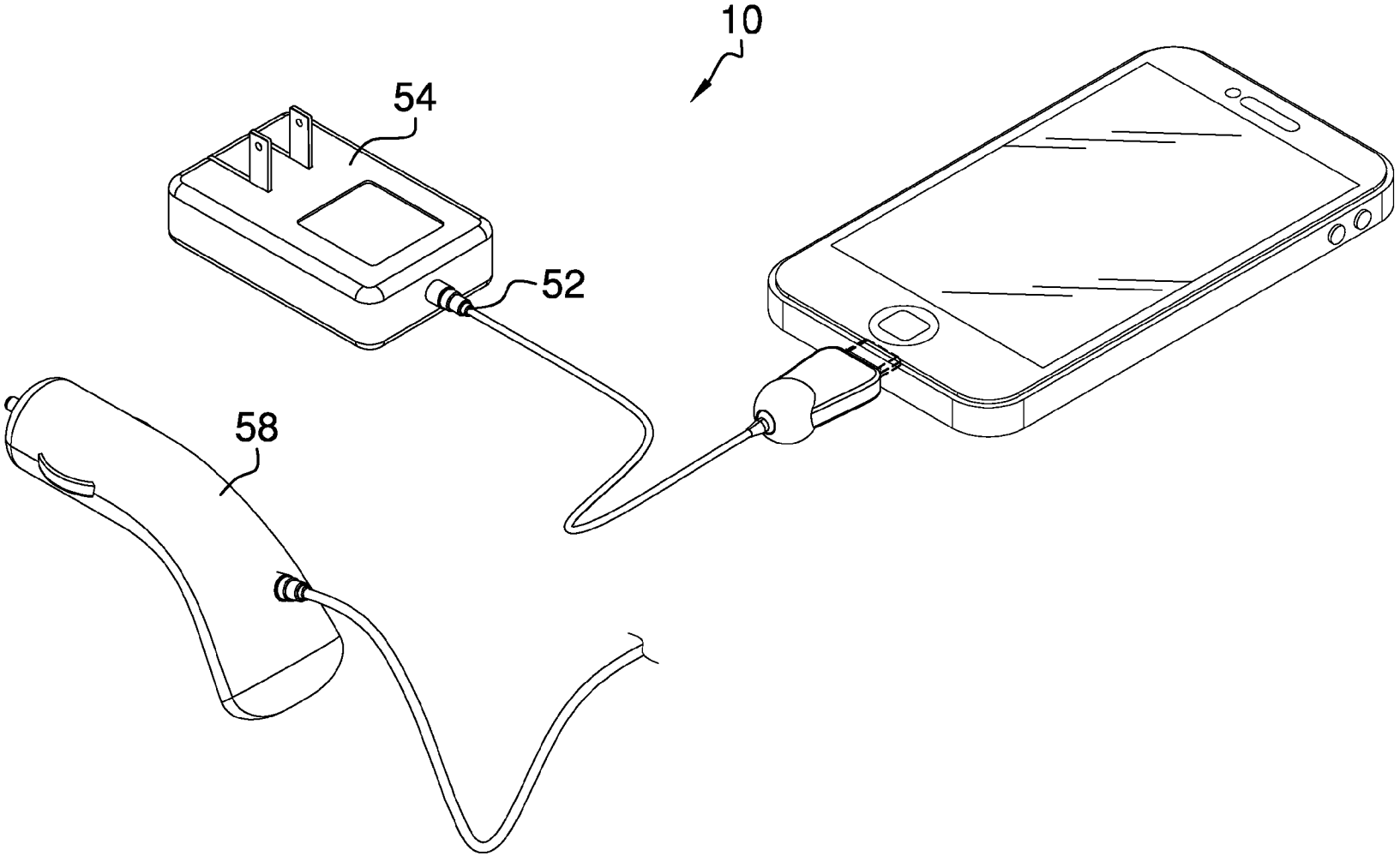
FIG. 2 is a rear isometric view.
Figure 3:
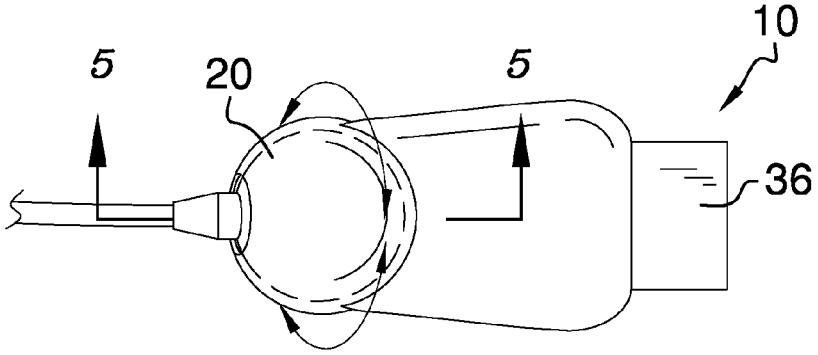
FIG. 3 is a top plan view.
Figure 4:
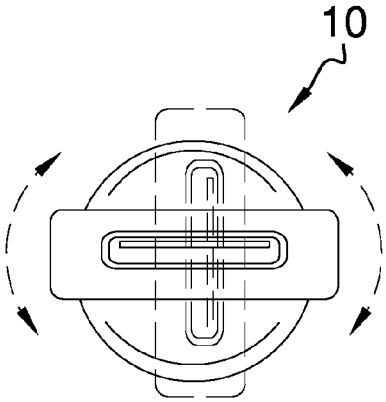
FIG. 4 is a front elevation view.
Figure 5:
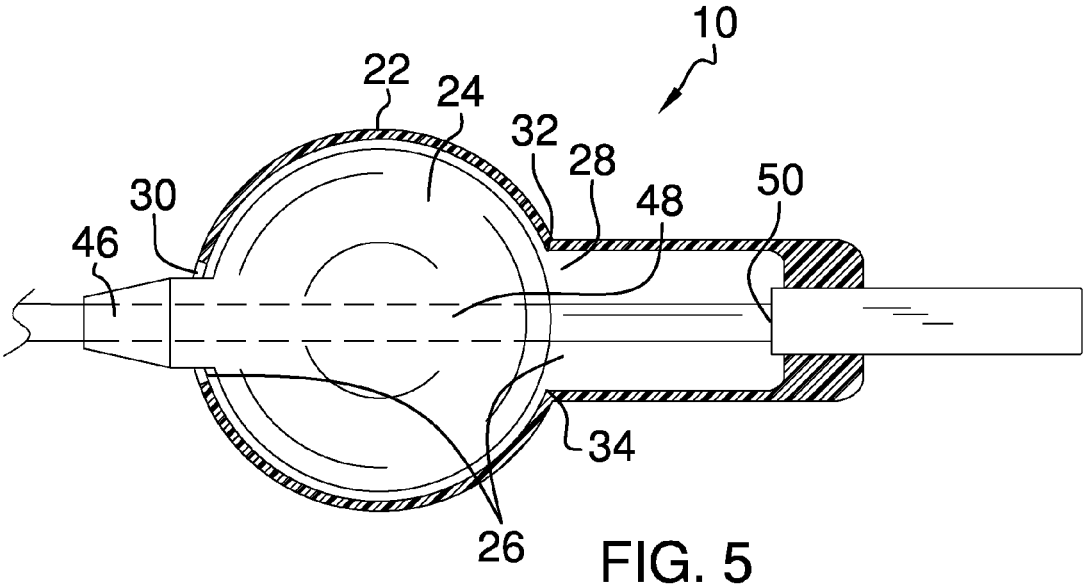
FIG. 5 is a cross-sectional view taken along line 5-5 of FIG. 3.

With reference now to the drawings, and in particular FIGS. 1 through 5 thereof, an example of the instant swivel joint charging connector employing the principles and concepts of the present swivel joint charging connector and generally designated by the reference number 10 will be described.

Referring to FIGS. 1 through 5 the present swivel joint charging connector 10 is illustrated. The swivel joint charging connector 10 includes a swivel ball joint 20 having an exterior shell 22 disposed around a rotatable ball 24. A pair of apertures 26 is disposed on the exterior shell 22 of the swivel ball joint 20. The pair of apertures 26 includes a first aperture 28 and a second aperture 30. Each of the first aperture 28 and the second aperture 30 has an upper edge 32 and a lower edge 34. The first aperture 28 is collinearly disposed with the second aperture 30. A USB connector 36 has a male plug 38 and a tapered substantially rectangular body portion 40. The body portion 40 has a front end 42 attached to the male plug 38, a rounded right front corner 60, a rounded left front corner 62, and a curved and inwardly tapered back end 44 continuously attached to the exterior shell 22 of the swivel ball joint 20 at each of the upper edge 32 and the lower edge 34 of the first aperture 28. A wire cover 46 is disposed through the second aperture 30 and attached to the ball 24. The wire cover 46 is continuously disposed around a wire 48 having a right end 50 and a left end 52. The wire 48 is continuously disposed through the ball 24 and each of the first aperture 28 and the second aperture 30. The right end 50 of the wire 48 is attached to the USB connector 36, and the left end 52 of the wire 48 is attached to a power connector 54. The power connector 54 is optionally an outlet power plug 56 and, alternately, a cigarette lighter plug 58.

What is claimed is:

1. A swivel joint charging connector comprising:

a swivel ball joint having an exterior shell disposed around a rotatable ball;

a pair of apertures disposed on the exterior shell of the swivel ball joint, the pair of apertures comprising a first aperture and a second aperture, each of the first aperture and the second aperture having an upper edge and a lower edge, wherein the first aperture is collinearly disposed with the second aperture;

a USB connector having a male plug and a tapered substantially rectangular body portion, the body portion having a front end attached to the male plug, a rounded right front corner, a rounded left front corner, and a curved and inwardly tapered back end continuously attached to the exterior shell of the swivel ball joint at each of the upper edge and the lower edge of the first aperture;

a wire cover disposed through the second aperture and attached to the ball, wherein the wire cover is continuously disposed around a wire having a right end and a left end, wherein the wire is continuously disposed through the ball and each of the first aperture and the second aperture, wherein the wire right end is attached to the USB connector and the wire left end is attached to a power connector;

wherein a diameter of the wire cover substantially conforms to a diameter of the second aperture;

wherein the ball is configured to have 360 degrees of pivotable rotation in order to provide simultaneous rotation to the wire.

2. The swivel joint charging connector of claim 1 wherein the power connector is an outlet power plug.

3. The swivel joint charging connector of claim 1 wherein the power connector is a cigarette lighter plug.

* * * * *